US008365559B2

(12) United States Patent
Agbay

(10) Patent No.: US 8,365,559 B2
(45) Date of Patent: Feb. 5, 2013

(54) KEY MECHANISM

(75) Inventor: Anthony John Agbay, Spencer, MA (US)

(73) Assignee: Inner-Tite Corp., Holden, MA (US)

( * ) Notice: Subject to any disclaimer, the term of this patent is extended or adjusted under 35 U.S.C. 154(b) by 278 days.

(21) Appl. No.: 12/837,906

(22) Filed: Jul. 16, 2010

(65) Prior Publication Data

US 2012/0011908 A1 Jan. 19, 2012

(51) Int. Cl.
*E05B 67/36* (2006.01)
*E05B 19/04* (2006.01)

(52) U.S. Cl. ..... 70/34; 70/386; 70/395; 70/399; 70/408; 70/456 R

(58) Field of Classification Search ..... 70/34, 386, 70/395, 408, 399, 456 R; 408/84
See application file for complete search history.

(56) References Cited

U.S. PATENT DOCUMENTS

| | | | | | |
|---|---|---|---|---|---|
| 939,679 | A * | 11/1909 | Freud | 70/411 |
| 1,010,094 | A * | 11/1911 | Tolnay | 70/46 |
| 1,090,736 | A * | 3/1914 | Martin | 70/70 |
| 1,333,887 | A * | 3/1920 | Warren | 70/395 |
| 1,356,747 | A * | 10/1920 | Skolneek | 70/355 |
| 1,382,826 | A * | 6/1921 | Dove | 70/358 |
| 1,426,573 | A * | 8/1922 | Kovach et al. | 70/355 |
| 1,464,194 | A * | 8/1923 | Bartolacelli | 70/38 A |
| 1,750,542 | A * | 3/1930 | Pucek | 70/355 |
| 1,974,769 | A * | 9/1934 | Elliott | 70/107 |
| 2,012,693 | A * | 8/1935 | Rieback | 70/120 |
| 3,015,240 | A * | 1/1962 | Hodnett | 408/84 |
| 3,446,045 | A * | 5/1969 | Finck, Jr. | 70/34 |
| 3,509,749 | A * | 5/1970 | Arzig et al. | 70/492 |
| 3,808,853 | A * | 5/1974 | Helenurm | 70/411 |
| 4,100,777 | A * | 7/1978 | Fredon | 70/491 |
| 4,557,124 | A * | 12/1985 | Russ | 70/456 R |
| 4,662,200 | A * | 5/1987 | Borda | 70/411 |
| 4,747,282 | A * | 5/1988 | Nyun | 70/426 |
| 5,086,631 | A * | 2/1992 | Agbay | 70/366 |
| 5,318,390 | A * | 6/1994 | DalBianco | 408/84 |
| 5,355,702 | A * | 10/1994 | Escribens | 70/395 |
| 5,440,909 | A * | 8/1995 | Ely et al. | 70/395 |
| 5,592,839 | A * | 1/1997 | Hasan | 70/456 R |
| 5,704,235 | A * | 1/1998 | Stahle | 70/456 R |
| 5,706,683 | A * | 1/1998 | Napier | 70/398 |
| 6,173,595 | B1 * | 1/2001 | Hughes | 70/394 |
| 6,386,006 | B1 * | 5/2002 | DeWalch | 70/34 |
| 2003/0101782 | A1 * | 6/2003 | Wendt | 70/394 |

* cited by examiner

*Primary Examiner* — Lloyd Gall
(74) *Attorney, Agent, or Firm* — McCormick, Paulding & Huber LLP

(57) ABSTRACT

A key mechanism that includes a key having a shank portion and a grip portion secured to the shank portion. The mechanism further includes a frame with the key being rotatably secured within the frame such that the shank portion protrudes from a first end of the frame. The grip portion of the key may be accessed and rotated to rotate the shank portion while the key is in the frame allowing one-handed operation of the key mechanism.

18 Claims, 5 Drawing Sheets

KEY MECHANISM

FIELD OF THE INVENTION

The present invention relates generally to a key mechanism and more particularly to a key mechanism that allows for one-handed operation.

BACKGROUND OF THE INVENTION

As will be readily appreciated, many known locking mechanisms are operated through the insertion and rotation of a key. Rotating disk style barrel locks, however, have a tendency to rotate along with the key during use making operation of the key and lock difficult. An exemplary rotating disk barrel lock is disclosed in U.S. Pat. No. 5,086,631, which is hereby incorporated by reference in its entirety.

Known solutions to the aforementioned issue, while effective, involve two-handed operation of a key. In particular, a known solution involves the use of a key that includes two interconnected components, the key itself and a key body that rotates about the key. The key body includes a series of recessed notches that engage corresponding protrusions on the lock head. In operation, a user inserts the key so that the protrusions engage the notches and then holds the key body in place to prevent rotation of the barrel lock. Then, while holding the key body with one hand, the handle of the key is rotated with the user's other hand to install or remove the lock.

While this is solution is efficacious, it is generally desirable to have a key that requires only one-hand to operate. More specifically, many rotating disk barrel locks are employed in the utility industry and are often located in protective boxes that are relatively small and cramped providing the installer with a limited range of motion. Such locks may also be recessed such that the key body and lock cannot be grabbed. As such, the two-handed operation of a key is challenging in these restricted confines making the removal and installation of such locks difficult.

SUMMARY OF THE INVENTION

It is an object of the present invention to provide a key mechanism.

It is an additional object of the present invention to provide a key mechanism that allows for one-handed operation.

It is an additional object of the present invention to provide a key mechanism that allows for one-handed operation facilitating the easy removal of rotating disk barrel locks or any barrel lock that requires key rotation to lock or unlock.

It is an additional object of the present invention to provide a key mechanism assembly that may be easily manufactured.

An embodiment of the present invention is a key mechanism that includes a key having a shank portion and a grip portion secured to the shank portion. The mechanism further includes a frame with the key being rotatably secured within the frame such that the shank portion protrudes from a first end of the frame. The grip portion of the key may be accessed and rotated to rotate the shank portion while the key is in the frame allowing one-handed operation of the key mechanism.

Another embodiment of the present invention is a key mechanism for one-handed operation of a barrel lock includes a key having a shank portion and a grip portion secured to the shank portion. The mechanism further includes a frame, with the key being rotatably secured within the frame such that the shank portion protrudes from a first end of the frame. The frame further includes a handle end opposite from the first end. The first end of the frame includes a plurality of recesses which receive protrusions on an exterior surface of a barrel lock when the shank of the key is inserted in the barrel lock. The grip portion of the key may be accessed and rotated to rotate the shank portion while the key is in the frame allowing one-handed operation of the key mechanism.

An additional embodiment of the present invention includes a barrel lock and key system for locking a rotating barrel lock. The system includes a barrel lock having a rotating locking mechanism and a series of protrusions on an exterior of the barrel lock. The system further includes a key having a shank portion and a grip portion secured to the shank portion, the key being rotatably secured within a frame such that the shank portion protrudes from a first end of the frame. The frame further including a handle end opposite from the first end, the first end of said frame including a plurality of recesses that receive the protrusions on an exterior surface of a barrel lock when the shank of the key is inserted in the barrel lock to prevent the lock from rotating. The grip portion of the key may be accessed and rotated to rotate the shank portion while the key is in the frame allowing one-handed operation of the key mechanism.

Yet another embodiment of the inventive is a method of one-handed operation of a key to lock or unlock a barrel lock. The method includes the steps of holding a key frame in one hand. The shank of a key located within the key frame in then inserted into a barrel lock such that at least one protrusion on the barrel lock engages a corresponding recess in the key frame to prevent said barrel lock from rotating with said shank. A grip portion of the key located within the frame is rotated with the same hand that is holding the frame. Rotation of the grip portion rotates the shank to lock or unlock the barrel lock.

DETAILED DESCRIPTION OF THE INVENTION

Figure 1:
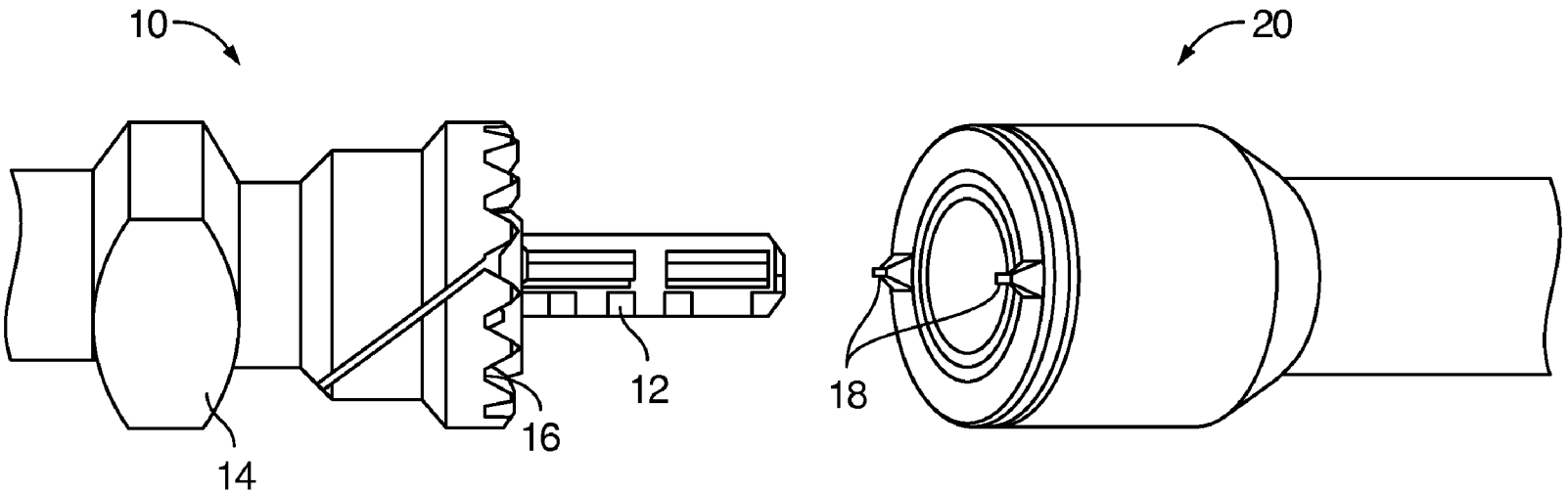
FIG. 1 Prior Art
FIG. 1 is a view of a prior art key, key body and barrel lock requiring two-handed operation.
Figure 2:
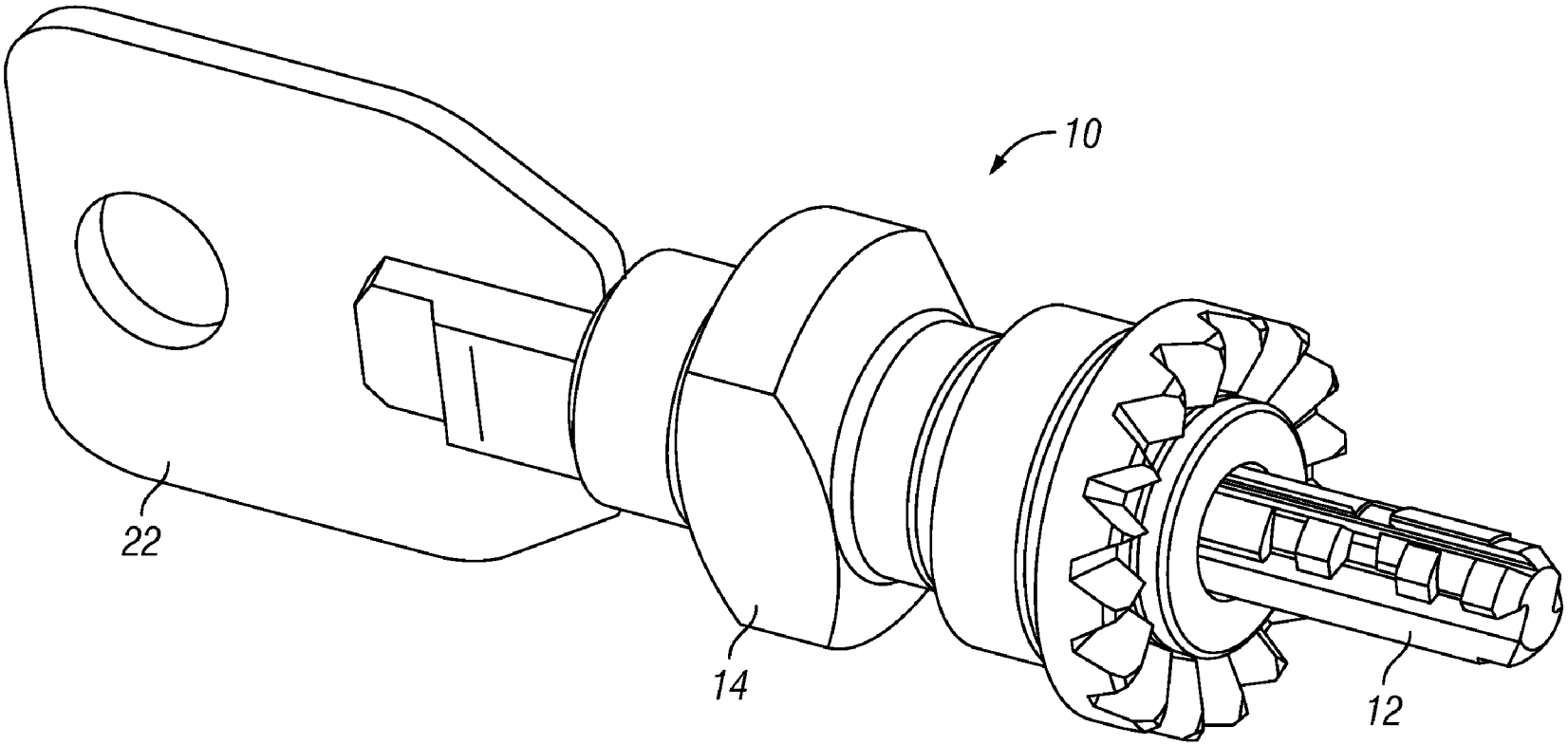
FIG. 2 (Prior Art)
FIG. 2 is a perspective view of the prior art key and key body of FIG. 1.
Figure 3:
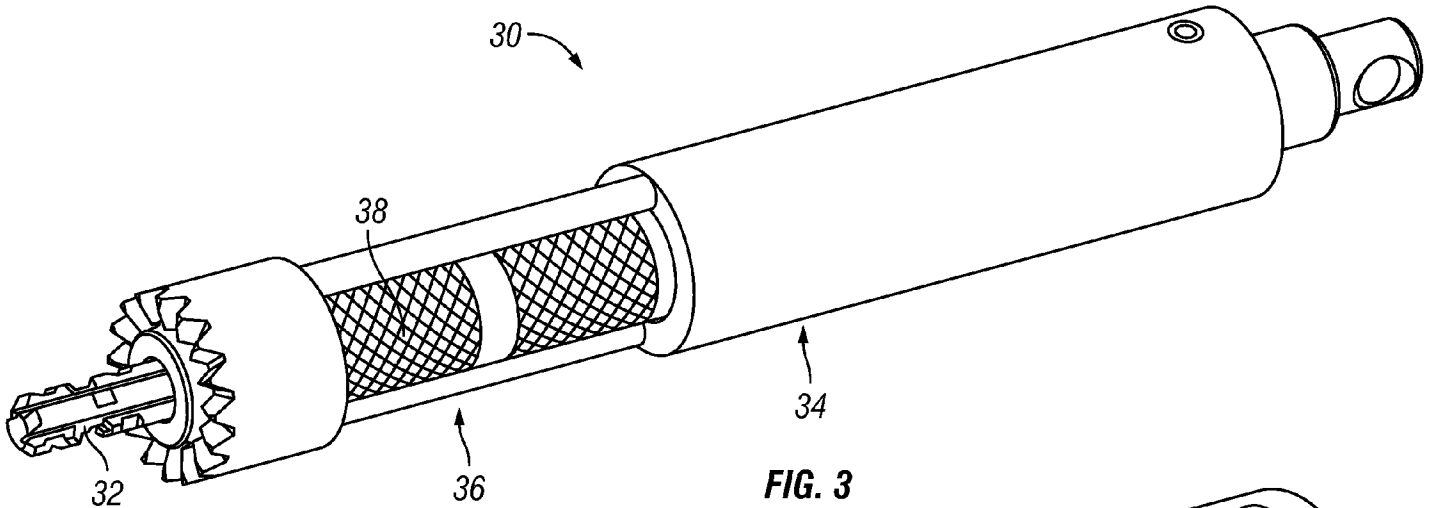
FIG. 3 is a perspective view of a key mechanism is accordance with an embodiment of the present invention.
Figure 4:
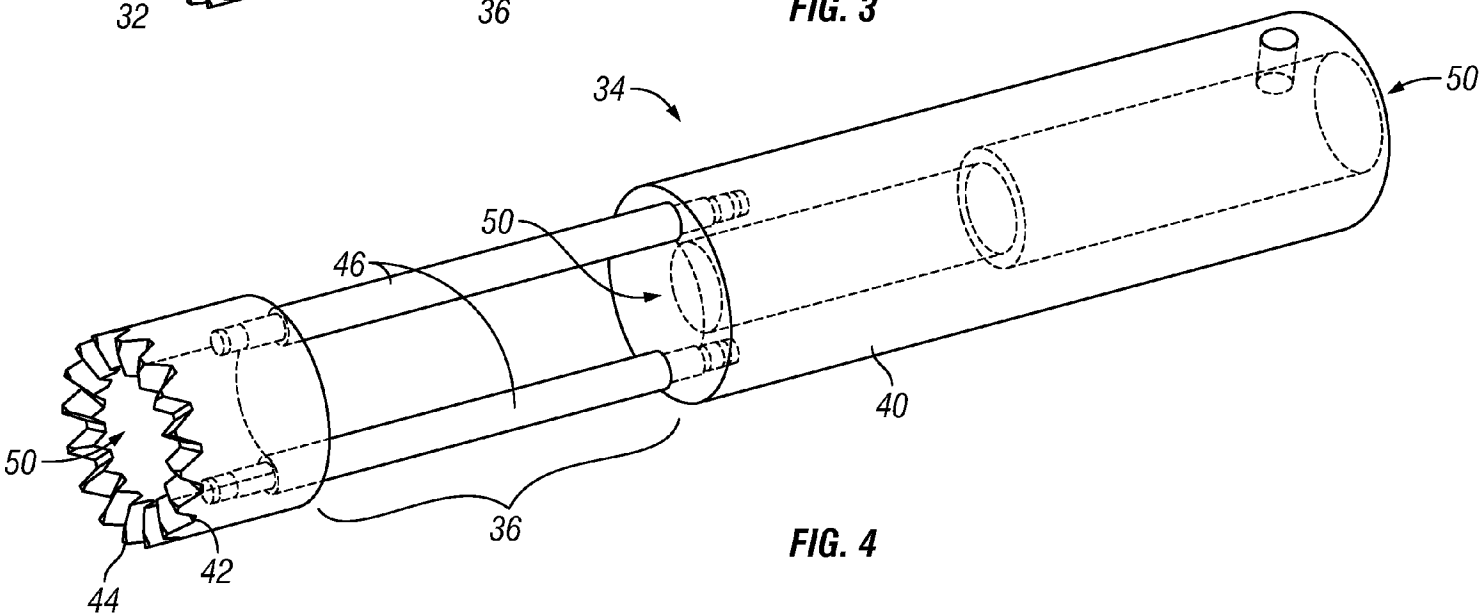
FIG. 4 is a see thru perspective view of a frame of the key mechanism of FIG. 3.

FIGS. 1 and 2 depict a known key assembly 10 that is used to prevent rotation of a barrel lock 20 during operation. As shown, the known assembly 10 includes a key 12 and key body 14 secured about the key 12. The key body 14 is freely rotatable about the key 12. The key body 14 includes a series of recessed notches 16 that receive protrusions 18 on an exterior surface of the barrel lock 20.

In operation, a user inserts the key 12, so that the protrusions 18 engage the recessed notches 16, and holds the key body 14 in place to prevent rotation of the barrel lock 20. Then, while holding the key body 14 with one hand, a handle portion 22 of the key 12 is rotated with the user's other hand to install or remove the barrel lock 20.

As stated, many rotating disk barrel locks are employed in the utility industry and are often located in small, cramped environs that provide the installer with a limited room and range of motion. Moreover, such locks may be recessed making them difficult to access. The two-handed operation of such a key is challenging in these restricted confines and the removal and installation of such barrel locks is a difficult endeavor.

Turning now to FIGS. 3-7, an embodiment of the inventive key mechanism 30 addresses this issue, among others, and allows for one-handed operation of a barrel lock, and in particular, a rotating disk barrel lock.

In general, an embodiment of the key mechanism 30 includes a key 32 that is rotatably secured within a frame 34. The frame 34 has an open portion 36 that is open to expose a grip portion 38 of the key 32 that, as discussed below, is rotated during operation.

In particular, the frame 34 has a handle end 40 and an opposite, engagement end 42 that includes a series of recesses 44, that, in a preferred embodiment, are wedge or V-shaped. The recesses 44 are configured to engage protrusions on the outer surface of a barrel lock, such as the known lock shown in FIG. 1. The handle 40 and key end 42 are operatively connected to one another via pins 46. As depicted, the pins 46 are also used to space apart the handle and engagement ends 40, 42 thereby forming the open portion 36.

Figure 5:
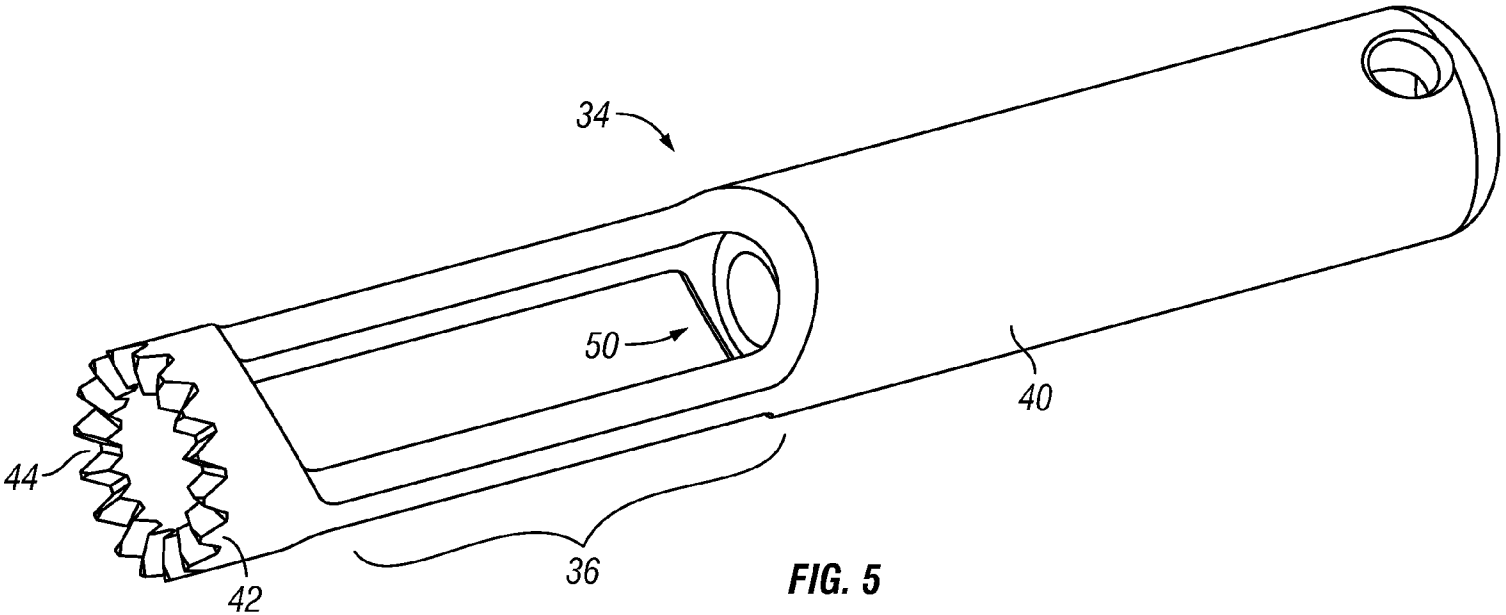
FIG. 5 is a perspective view of an alternative embodiment of the frame of FIG. 4.

Alternatively, as depicted in FIG. 5, the frame 34 may be formed from a single piece of material, e.g., from metal. In this embodiment, the open portion 36 is machined into the frame 34.

The open portion 36 is an important aspect of the present invention. As will be appreciated, the open portion 36 allows the grip portion 38 of the key 32 to be accessed and manipulated, i.e., rotated, with the same hand that the user employs to grasp the frame 34.

Figure 6:
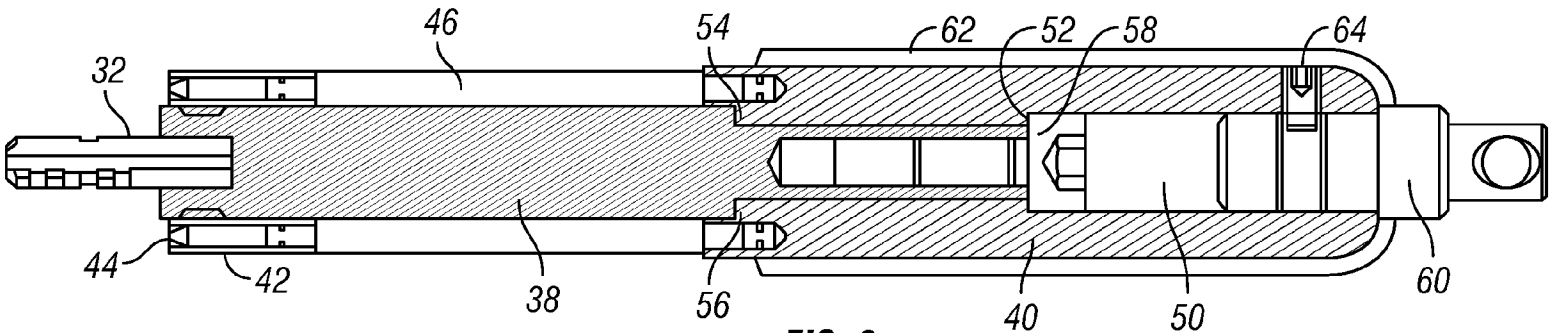
FIG. 6 shows a cross section of the fully assembled key mechanism of FIG. 3.
Figure 7:
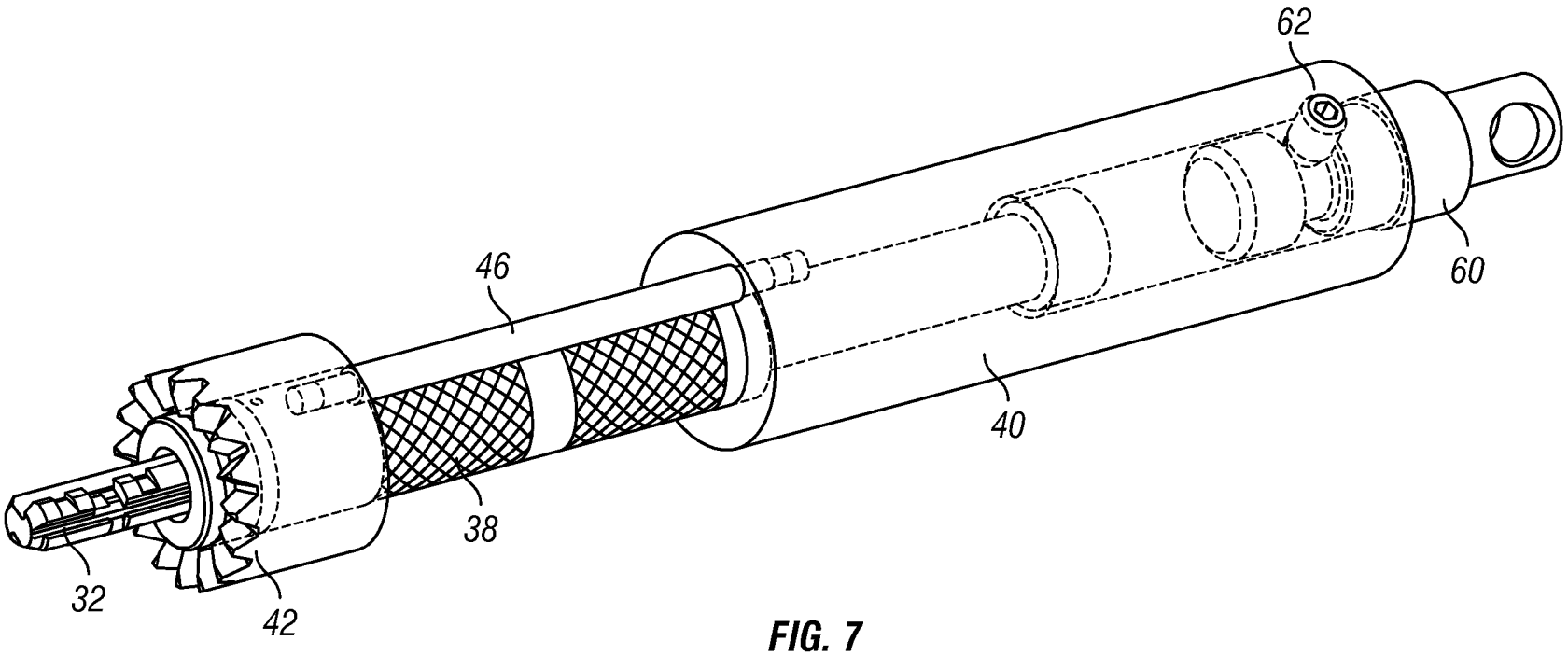
FIG. 7 is an additional perspective view of the key mechanism of FIG. 3.

Referring now to FIG. 6, the frame 34 further includes a central bore 50, which extends completely through the handle and engagement ends 40, 42. The central bore 50 accommodates the key 32 and allows the key 32 to be rotated within the frame 40.

The bore 50 preferably has a first shoulder 52 and a second shoulder 54 which allow the key 32 to be rotatably fixed within the frame 34. More specifically, the key 32 is inserted within the bore 50 from the engagement end 42 until a shoulder 56 of the grip portion 38 of the key 32 abuts the second shoulder 54 of the frame. A fastener 58 is then placed through the bore 50 at its handle end 40 and into an aperture in the key 32 until the fastener abuts the first shoulder 52 thereby fixing it within the frame 34 while allowing key 32 to rotate within frame 34. As will be appreciated, the fastener 58 and aperture are preferably threaded and may be, for example, an Allen bolt.

An optional end cap 60 is then placed within the bore 50 and secured in place with a fastener 64. As shown, the end cap may include a key chain adaptor to enhance portability of the key mechanism. A sleeve 62, manufactured from a pliable material such as rubber, is placed over the handle end 40 to facilitate operation of the key mechanism 30. The sleeve 62 provides an easily gripped surface to facilitate use of the mechanism 30.

In use, a user places the handle end 40 of the frame in his or her hand and inserts the shank of the key 32 into the barrel lock such that the protrusions 18 (FIG. 1) on the lock extend into the recesses 44 of the frame 34. Then, while continuing to grip the handle end 40, the user can rotate the grip portion 38 of the key 32 with his or her thumb and forefinger of the same hand. As will be appreciated, rotation of the grip portion 38 rotates the shank of the key 32 in the lock and either locks or unlocks the barrel lock. In this manner, one-handed operation of the key is possible.

The grip portion 38 of the key 32 is sized such that it may be easily rotated within the frame 34. To further facilitate rotation, the grip portion 38 may be knurled or otherwise textured to provide an enhanced grip. The grip portion 38 and shank 32 may be unitary, i.e., formed from a single piece of material or may be separate interconnected components.

The inventive key mechanism 30 is preferably manufactured from a durable metal as it may be employed in the utility industry and, as a result, may see frequent use. To this end, a protective cap (not shown) may be placed over the shank of the key 32 when it is not in use to prevent damage to the same.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. While the dimensions and types of materials described herein are intended to define the parameters of the invention, they are by no means limiting and are exemplary embodiments. Many other embodiments will be apparent to those of skill in the art upon reviewing the above description. The scope of the invention should, therefore, be determined with reference to the appended claims, along with the full scope of equivalents to which such claims are entitled.

In the appended claims, the terms "including" and "in which" are used as the plain-English equivalents of the respective terms "comprising" and "wherein." Moreover, in the following claims, the terms "first," "second," "third," "upper," "lower," "bottom," "top," "up," "down," etc. are used merely as labels, and are not intended to impose numerical or positional requirements on their objects. Further, the limitations of the following claims are not written in means-plus-function format and are not intended to be interpreted based on 35 U.S.C. §112, sixth paragraph, unless and until such claim limitations expressly use the phrase "means for" followed by a statement of function void of further structure.

This written description uses examples to disclose several embodiments of the invention, including the best mode, and also to enable any person skilled in the art to practice the embodiments of invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

As used herein, an element or step recited in the singular and proceeded with the word "a" or "an" should be understood as not excluding plural of said elements or steps, unless such exclusion is explicitly stated. Furthermore, references to "one embodiment" of the present invention are not intended to be interpreted as excluding the existence of additional embodiments that also incorporate the recited features. Moreover, unless explicitly stated to the contrary, embodiments "comprising," "including," or "having" an element or a plurality of elements having a particular property may include additional such elements not having that property.

Since certain changes may be made in the above-described key mechanism, without departing from the spirit and scope of the invention herein involved, it is intended that all of the subject matter of the above description or shown in the accompanying drawings shall be interpreted merely as examples illustrating the inventive concept herein and shall not be construed as limiting the invention.

What is claimed is:

1. A key mechanism, said mechanism comprising:

a frame having a first end and a handle end opposite said first end, and an opening in said frame adjacent to said first end;

a key having a shank portion and a grip portion secured to said shank portion, said key being rotatably secured within said frame such that said shank portion protrudes from said first end of said frame; and wherein said grip portion of said key may be accessed through said opening and rotated to rotate said shank portion while said key is in said frame allowing for one-handed operation of said key mechanism.

2. The key mechanism of claim 1, wherein said first end of said frame includes at least one recess, said recess receiving a protrusion on an exterior surface of a barrel lock when said shank portion of said key is inserted in said barrel lock.

3. The key mechanism of claim 1, wherein said handle end and said first end are spaced apart from one another allowing access to said grip portion of said key so that it may be rotated.

4. The key mechanism of claim 3, wherein said handle end and said first end are spaced apart from one another through a plurality of pins.

5. The key mechanism of claim 1, wherein said handle end and said first end include a through bore that receives said key.

6. The key mechanism of claim 1, wherein said grip portion of said key is knurled.

7. A key mechanism for one-handed operation of a barrel lock, said mechanism comprising:

a key having a shank portion and a grip portion secured to said shank portion;

a frame having an opening, said key being rotatably secured within said frame such that said shank portion protrudes from a first end of said frame, said frame further including a handle end opposite from said first end, wherein said first end of said frame includes a plurality of recesses, said recesses receiving protrusions on an exterior surface of a barrel lock when said shank portion of said key is inserted in said barrel lock; and wherein said grip portion of said key may be accessed through said opening and rotated to rotate said shank portion while said key is in said frame allowing for one-handed operation of said key mechanism.

8. The key mechanism of claim 7, wherein said handle end and said first end are spaced apart from one another allowing access to said grip portion of said key so that it may be rotated.

9. The key mechanism of claim 8, wherein said handle end and said first end are spaced apart from one another through a plurality of pins.

10. The key mechanism of claim 7, wherein said handle end and said first end include a through bore, which receives said key.

11. The key mechanism of claim 7, wherein said grip portion of said key is knurled.

12. A barrel lock and key system for locking a rotating barrel lock, said system comprising:

a barrel lock having a rotating locking mechanism, said barrel lock having a series of protrusions on an exterior surface of said barrel lock;

a key having a shank portion and a grip portion secured to said shank portion, said key being rotatably secured within a frame such that said shank portion protrudes from a first end of said frame, said frame further including a handle end opposite from said first end and an opening in said frame adjacent to said first end, wherein said first end of said frame includes a plurality of recesses, said recesses receiving said protrusions on said exterior surface of said barrel lock when said shank portion of said key is inserted in said barrel lock to prevent said lock from rotating; and wherein said grip portion of said key may be accessed through said opening and rotated to rotate said shank portion while said key is in said frame allowing one-handed operation of said key in said barrel lock.

13. The barrel lock and key system of claim 12, wherein said handle end and said first end are spaced apart from one another allowing access to said grip portion of said key so that it may be rotated.

14. The barrel lock and key system of claim 13, wherein said handle end and said first end are spaced apart from one another through a plurality of pins.

15. The barrel lock and key system of claim 12, wherein said handle end and said first end include a through bore, which receives said key.

16. The barrel lock and key system of claim 12, wherein said grip portion of said key is knurled.

17. A method of one-handed operation of a key to lock or unlock a barrel lock, said method comprising the steps of:

holding a key frame in one hand;

inserting a shank of a key located within said key frame into a barrel lock such that at least one protrusion on said barrel lock engages a corresponding recess in said key frame to prevent said barrel lock from rotating with said shank;

rotating a grip portion of said key with the same hand that is holding said frame, said grip portion of said key being located within said frame and accessible through an opening in said frame adjacent to said shank; and wherein rotation of said grip portion rotates said shank to lock or unlock said barrel lock.

18. The method of claim 17 wherein said grip portion is knurled.

* * * * *